US007802669B2

(12) United States Patent
Irie

(10) Patent No.: US 7,802,669 B2
(45) Date of Patent: Sep. 28, 2010

(54) TOKEN IMAGE ACQUIRING APPARATUS AND TOKEN SELECTING APPARATUS FOR VALIDATING TOKENS

(75) Inventor: Yasuo Irie, Saitama (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 533 days.

(21) Appl. No.: 11/675,518

(22) Filed: Feb. 15, 2007

(65) Prior Publication Data

US 2007/0249276 A1 Oct. 25, 2007

(30) Foreign Application Priority Data

Feb. 16, 2006 (JP) ..... 2006-039148

(51) Int. Cl.
*G07D 5/00* (2006.01)

(52) U.S. Cl. ..... 194/328; 453/6; 453/33; 453/49; 453/57; 382/136

(58) Field of Classification Search ..... 194/338, 194/328–331; 453/14, 6, 10, 12, 13, 33–35, 453/49, 57; 382/136
See application file for complete search history.

(56) References Cited

U.S. PATENT DOCUMENTS 3,921,003 A * 11/1975 Greene ..... 250/557
5,992,602 A * 11/1999 Zwieg et al. ..... 194/317
6,431,342 B1 * 8/2002 Schwartz ..... 194/346
6,729,461 B2 * 5/2004 Brandle et al. ..... 194/317
2001/0008200 A1 * 7/2001 Yoshida et al. ..... 194/318
2003/0201146 A1 * 10/2003 Abe et al. ..... 194/302

FOREIGN PATENT DOCUMENTS

| | | |
|---|---|---|
| JP | 2002-358550 | 12/2002 |
| JP | 2004-030355 | 1/2004 |
| JP | 2004-227366 | 8/2004 |
| JP | 2006-004166 | 1/2006 |

* cited by examiner

*Primary Examiner*—Jeffrey A Shapiro

(57) ABSTRACT

A coin or token image acquiring apparatus includes a coin moving unit for receiving coins in a sequential manner and translating each coin to a predetermined station. A time sensor unit detects the position of the respective coins in the coin moving unit and provides a timing signal that can activate an image apparatus unit positioned at the predetermined station. A light emitting apparatus is positioned to illuminate the coin face at the predetermined station so that the image apparatus can capture an illuminated image of the face of the coin. A storage unit can store a reference image of an authenticated coin image where by a comparator unit can compare the captured image of the coin with the authenticated coin image to provide an authenticated output signal when the respective image is matched. A separator unit can separate false coins from authenticated coins.

7 Claims, 6 Drawing Sheets

TOKEN IMAGE ACQUIRING APPARATUS AND TOKEN SELECTING APPARATUS FOR VALIDATING TOKENS

BACKGROUND OF THE INVENTION

1. Field of the Invention

The present invention relates to a token image acquiring apparatus which can acquire an image of a token using an imaging apparatus. Particularly, the present invention relates to a token image acquiring apparatus which can acquire an image of a token while moving at a relatively high velocity by using a coordinated imaging apparatus. Further, the present invention relates to a medal storing and selecting apparatus provided with a token image acquiring apparatus which acquires an image of a moving token using an imaging apparatus to perform sorting between a real token and a fake token.

2. Description of Related Art

Incidentally, the term "token" used in this specification is a broad term to include coins, game tokens, medals and other members representative of value and of a shape such as a circle and a polygon that can be stored in bulk and individually separated.

Japanese Laid Open Application 2004-227366 discloses a technique for, in the course of conveying a coin linearly using an advancing belt, illuminating an upper face of the coin by a light emitting apparatus, acquiring an image thereof using an imaging apparatus, and conducting a discrimination between real/fake coins based upon the image information acquired. In this conventional art, a position of the coin on the belt is detected by a sensor and a light emitting timing of the light emitting apparatus and an imaging timing of a camera are set based upon a detection signal.

A second technique for, in the course of conveying a medal used in a game, is to place the medal linearly on a belt, acquire an image of a surface thereof using a camera, and conduct discrimination between real/fake by comparing the acquired image with reference image data. Subsequently, a fake medal can be removed from an advancing path to discharge the fake medal by a different coin discharging path, see JP-A-2002-358550 (FIGS. 1 to 3, Pages 2 to 4), JP-A-2006-004166 (FIGS. 1 to 4, Pages 3 to 5), and JP-A-2004-030355 (FIG. 1, Pages 4 to 6).

As token dispensing apparatus become more compact and operate at higher speeds, there is need to provide token validating apparatus to address these demands.

SUMMARY OF THE INVENTION

Recently, the number of tokens that are to be subjected to a discrimination processing per unit time has significantly increased in view of industry demands in commerce and the gaming industry. In the conventional art, since tokens are placed on a conveying belt to be conveyed, the tokens are conveyed utilizing a frictional force between the tokens and the conveying belt.

When the velocity of the conveying belt is increased in order to improve a token discrimination processing capacity per unit, a slippage may occur between a token and the conveying belt, which results in displacement of the token relative to the conveying belt.

If light is emitted by a light emitting apparatus based upon a signal outputted when a sensor detects a token, an imaging processing by the camera is performed, and image information is taken.

Accordingly, when slippage occurs between the token and the belt in a time period after the token is detected by the sensor, light is emitted late by the light emitting apparatus and before the imaging processing of the camera is performed, and inconsistency between the position of the token, and the light emission from the light emitting apparatus and the imaging processing of the camera occurs, and predetermined image information cannot be obtained. Thus a problem occurs so that accurate sorting of the token cannot be performed.

A first object of the present invention is to provide a token image acquiring apparatus which can acquire accurate image information of a token without causing any positional inconsistency of the token even if a moving velocity of the token significantly increases.

A second object of the present invention is to provide a compact token image acquiring apparatus suitable for play facilities.

A third object of the present invention is to provide a token selecting apparatus provided with a token image acquiring apparatus, which can discriminate real/fake of a token based upon image information acquired by a token image acquiring apparatus to separate a token as a real token or a fake token reliably.

In order to achieve the above objects, a token image acquiring apparatus is provided which images a moving token using an imaging apparatus to acquire imaged information comprising a pressing and moving member which moves at a predetermined velocity, the imaging apparatus that images tokens pressed and moved by the pressing and moving member, and an aligning and supplying apparatus which supplies tokens to the pressing and moving member one by one.

The token image acquiring apparatus further can comprise a guiding member which guides the tokens pressed and moved by the pressing and moving member.

The token image acquiring apparatus includes a timing sensor unit which detects a position of the pressing and moving member directly or indirectly, and imaging processing is performed by the imaging apparatus based upon a timing signal of the timing sensor unit.

The token image acquiring apparatus includes a pressing and moving member as a portion of a rotary member.

The token image acquiring apparatus further includes an imaging apparatus with a light emitting apparatus and a camera, and the light emitting apparatus and the camera emit light to perform imaging processing by the camera based upon the timing signal of the timing sensor unit.

The token image acquiring apparatus includes the pressing and moving member which is thinner than a thickness of the token.

A token selecting apparatus is provided with a token image acquiring apparatus which images a moving token using an imaging apparatus to acquire imaged information, comprising: a rotary member which has a pressing and moving member; a guiding member which guides tokens pressed and moved by the pressing and moving member; an imaging apparatus which images tokens pressed and moved by the pressing and moving member; an aligning and supplying apparatus which supplies tokens to the pressing and moving member one by one; a discriminator unit which conducts discrimination about real/fake of a token based upon information imaged by the imaging apparatus; and a separator unit which separates tokens conveyed by the rotary member to a real token outlet or a fake token outlet based upon the discrimination result in the discriminator.

A token selecting apparatus is provided with a token image acquiring apparatus wherein the separator unit includes an inclined guiding face formed separate from a transportation plane including the guiding member and a deflecting member which is movable between a standby position flush with the guiding face and a deflected position which is separated from the guiding face to project into the plane.

With the above configurations, a large number of stored tokens can be supplied one by one to the pressing and moving member by the aligning and supplying apparatus. While being pressed, the tokens are moved according to the movement of the pressing and moving member.

The tokens pressed and moved are imaged by the imaging apparatus disposed on a transfer path at a predetermined station and image information is acquired. A moving velocity of the pressing and moving member is determined according to a rotating velocity of, for example, a motor. Accordingly, the moving velocity of a token depends on the moving velocity of the pressing and moving member and a transfer path of the tokens is determined.

In other words, by controlling light emission from the light emitting apparatus of the imaging apparatus and the imaging processing timing of the imaging apparatus according to a signal based upon the position of the pressing and moving member, the light emitting apparatus can be caused to emit light reliably when a surface of a token is positioned at an imaging position and an imaging processing of the imaging apparatus can be performed. As a result, there is an advantage in that imaged information of tokens can be acquired reliably.

When a token is moved along the imaging path according to pressing and moving of the pressing and moving member while being guided by the guiding member, the transfer path of the token is determined by the guiding member. Since a positional relationship between a moving token and the imaging apparatus is unambiguously determined by disposing the imaging apparatus at a predetermined position to the guiding member, there is an advantage in that the image information of the token can be obtained reliably.

A timing sensor unit can, directly or indirectly, detect the position of the pressing and moving member and an imaging processing in the imaging apparatus is performed based upon a timing signal of the pressing and moving member, in other words, imaging is performed by the imaging apparatus based upon the position of the pressing and moving member. Since image information of the token is obtained based upon the position of the pressing and moving member moving together with the token, the image information of the token can be obtained reliably.

When the pressing and moving member is made a portion of the rotary member, a token is pressed by the pressing and moving member according to rotation of the rotary member and is moved on an arc path. In this case, since the imaging apparatus, an outlet for a token, and the like can be disposed around the rotary member, the token image acquiring apparatus can be reduced in size, so that a small-sized and compact token image acquiring apparatus suitable for a game machine can be provided.

The imaging apparatus includes a light emitting apparatus and a camera, and when the light emitting apparatus and the camera emit light and perform the imaging processing based upon a timing signal of the timing sensor unit, light is emitted by the light-emitting apparatus in the imaging apparatus based upon a position signal of the pressing and moving member moving together with the token, so that the imaging processing in the camera is performed in a linking manner with the light emission. Accordingly, since a timing gap between the position of the token and the light emitting timing of the light emitting apparatus, and the imaging processing of the camera does not occur, there is an advantage in that the image information of the token can be acquired reliably.

When the thickness of the pressing and moving member is thinner than the thickness of the token, after light from the light emitting apparatus passes through the token, it reaches the pressing and moving member, so that the token is prevented from shading the pressing and moving member.

The image information of a token surface can be acquired without being influenced by the pressing and moving member, and the image information of the token can be accurately and reliably acquired.

When a token selecting apparatus can be provided with a token image acquiring apparatus which images a moving token using an imaging apparatus to acquire imaged information. The token image acquiring apparatus can be configured to include: a rotary member which has a pressing and moving member; a guiding member which guides tokens pressed and moved by the pressing and moving member; an imaging apparatus which images the tokens pressed and moved by the pressing and moving member; an aligning and supplying apparatus which supplies tokens to the pressing and moving member one by one; a discriminator unit which conducts discrimination about real/fake of a token based upon information image by the imaging apparatus; and a separator unit which separates tokens conveyed by the rotary member to a real token path or a fake token path based upon the discrimination result in the discriminator unit, therefore many tokens can be supplied to a transfer path of the pressing and moving member of the rotary member by the aligning and supplying apparatus one by one.

Then the tokens are pressed and moved by the pressing and moving member of the rotary member to be moved while being guided by the guiding member. The token pressed and moved is imaged by the imaging apparatus disposed on the transfer path and image information is acquired.

A rotating velocity of the rotary member is determined according to a rotating velocity of, for example, a motor. Accordingly, the moving velocity of the token depends on the rotating velocity of the rotary member. The transfer path of the tokens is unambiguously determined by the guiding member to be guided.

In other words, the imaging apparatus is disposed at a predetermined position to the guiding member, and the token can be imaged reliably by controlling light emission of the light emitting apparatus in the imaging apparatus and an imaging processing of the camera based upon the rotation position of the rotary member, so that imaged information of the token can be acquired reliably.

Real/fakeness of the token can be discriminated by the discriminator based upon the image information acquired by the imaging apparatus. The imaged token reaches the separator unit. The separator unit performs switching of a real token path or a fake token path based upon the discrimination result in the discriminator unit. Accordingly, since a real token is guided to the real token path and a fake token is guided to the fake token path, separating the token to the proper path can be performed.

When the separator unit includes an inclined guiding face formed to separate from a transporting token plane including the guiding member and a deflecting member which can be positioned between a standby position flush with the guiding face and a deflected position which is separated from the guiding face to project into the plane, a token is fed out in a predetermined direction at a high velocity by the rotary member, so that the token is advanced approximately horizontally.

Accordingly, since the token does not move along the inclined guiding face, in the case of the real token, the deflecting plate does not contact with the token, so that damage of the deflecting plate due to collision of the token at a high velocity can be prevented. In the case of the fake token, the deflecting plate advances into the advancing path of the token to guide the fake token to the fake token path. Thereby, tokens can be correctly selected to be a real token and or a fake token based upon the image information acquired from the tokens, and a service life of the deflecting plate can be extended.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
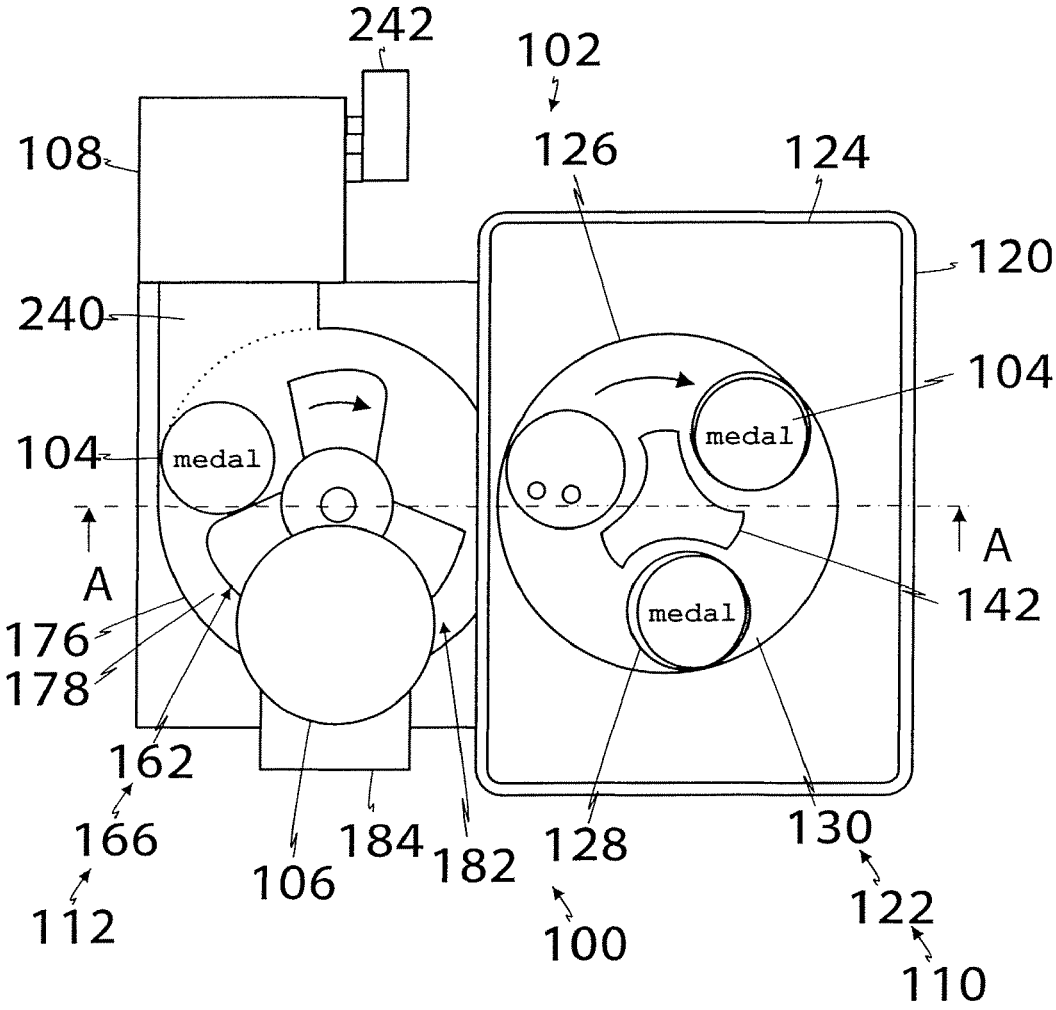
FIG. 1 is a plan view of a token selecting apparatus provided with a token image acquiring apparatus of an embodiment of the present invention.
Figure 2:
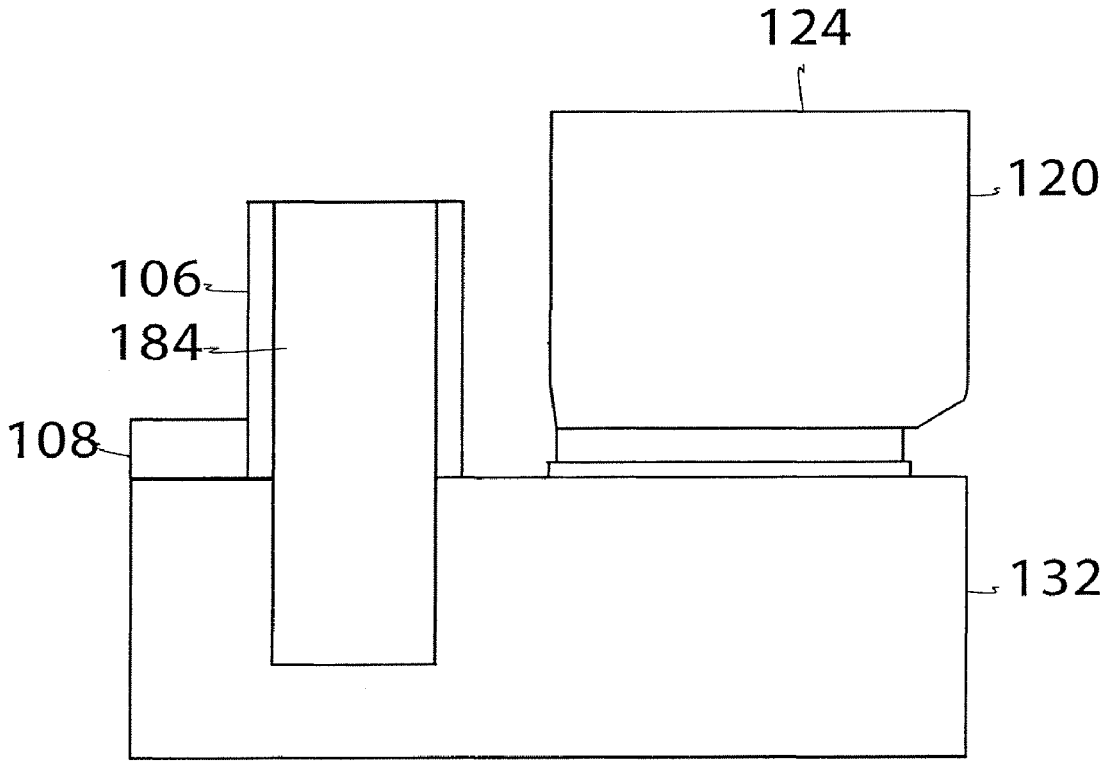
FIG. 2 is a front view of the token selecting apparatus provided with a token image acquiring apparatus of an embodiment of the present invention.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

The terminology "coin" as used in the present invention includes medallions, tokens, and other articles in addition to monetary coins that can be stored in bulk and dispensed through a guide passageway.

A token selecting apparatus 102 provided with a token image acquiring apparatus 100 has a function of imaging patterns from the face surfaces of many tokens 104 using an imaging apparatus 106 to acquire image information, thereby enabling a determination as to real/fakeness status of the tokens based upon the image information, and sorting the tokens as real tokens or fake tokens based upon the determination result using a separator unit 108.

The token image acquiring apparatus 100 will be first explained. After the token image acquiring apparatus 100 has a function of, after a token aligning and supplying apparatus separates bulk tokens 104 into single tokens, imaging the tokens 104 using the imaging apparatus 106 in the course of positively pressing and moving the tokens 104 using a pressing and moving member 162 to be described later. The token image acquiring apparatus 100 includes at least an aligning and supplying apparatus 110 which separates bulk tokens 104 into respective tokens to supply them to a next step, a pressing and moving apparatus 112 that presses and moves the tokens 104 separated by the aligning and supplying apparatus 110, and the imaging apparatus 106.

Next, the token aligning and supplying apparatus 110 will be explained. The aligning and supplying apparatus 110 has a function of separating tokens 104 stored in bulk into respective individual pieces to feed them to an imaging stage. Accordingly, the aligning and supplying apparatus 110 may be replaced with another apparatus having a similar function.

The aligning and supplying apparatus 110 in the preferred embodiment has a function of separating tokens 104 from a bulk state into individual tokens to feed them sequentially to the pressing and moving apparatus 112 at the next step and includes a vertical cylindrical storing bowl 120 and a feeding-out apparatus 122 positioned at the bottom of the storing bowl 120. The storing bowl 120 is formed in a vertical cylindrical shape as a whole, an upper portion thereof is approximately rectangular, and the storing bowl 120 has a receiving opening 124 at an upper end thereof, and it has a circular hole 126 at a lower end thereof. The storing bowl 120 has a function of storing many tokens 104 in a bulk state, and it is attachably/detachably attached to an upper face of a base 132 described below.

Next, the feeding-out apparatus 122 will be explained. The feeding-out apparatus 122 has a function of separating stored bulk tokens 104 stored in the storing bowl 120 into respective individual pieces to feed them out.

The feeding-out apparatus 122 in the preferred embodiment is a rotary disk 130 having a plurality of through-holes 128 and having a diameter slightly larger than a diameter of the token 104.

Figure 3:
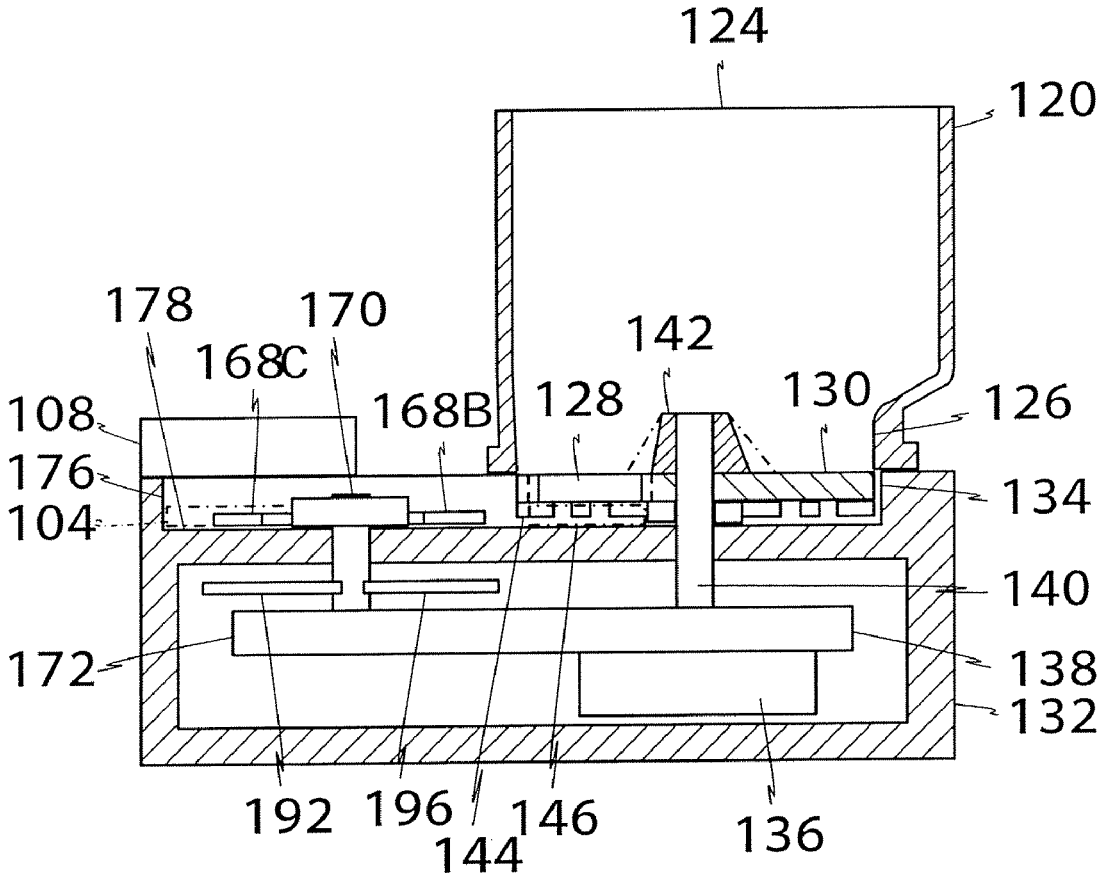
FIG. 3 is a sectional view of the token selecting apparatus, taken along line A-A in FIG. 1.

Referring to FIG. 3, the rotary disk 130 is disposed inside a first circular recessed portion 134 formed on an upper face of the base 132 positioned below the storing bowl 120, and it is rotated in a clockwise direction in FIG. 1 by an electric motor 136 fixed on the base 132 via reduction gears and a first rotating shaft 140. The rotary disk 130 has a convex-shape stirrer 142 at the center thereof, and it is disposed concentrically with the circular hole 126 of the storing bowl 120 in the first circular recessed portion 134 of the storing bowl 104. The rotary disk 130 has a pressing protrusion 144 on a back face of a rib between through-holes 128. The tokens 104 which have dropped in the through-hole 128 are supported on a base face 146 of the first circular recessed portion 134, and they are pressed by the pressing protrusion 144 according to rotation of the rotary disk 130 to move together with the rotary disk 130 while being guided by a peripheral face 148 of the first circular recessed portion 134.

Figure 4:
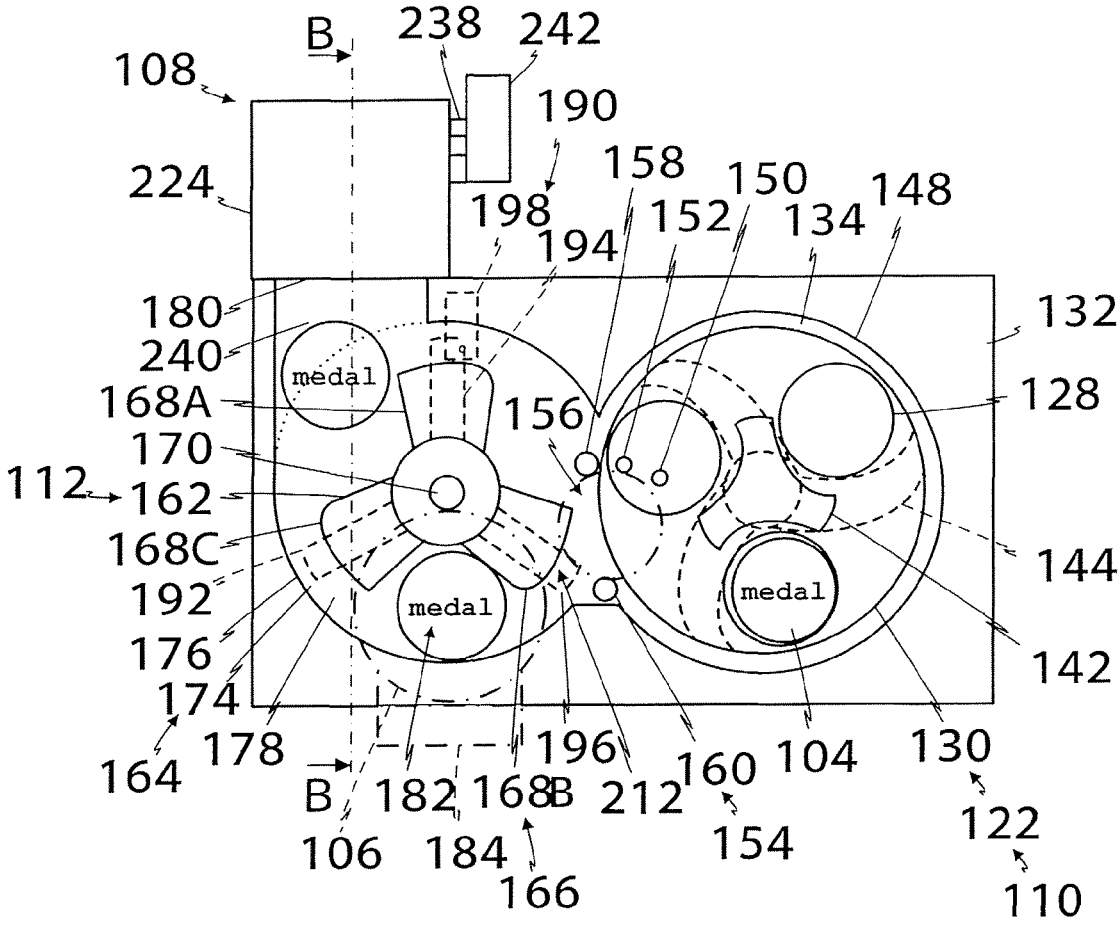
FIG. 4 is a mechanism explanatory view of the token selecting apparatus provided with a token image acquiring apparatus of an embodiment of the present invention.

The tokens 104 project from the base face 146 to be guided in a peripheral direction of the rotary disk 130 by restricting pins 150, 152 positioned on a transfer path for the token 104, see FIG. 4. The tokens 104 which have been guided in the peripheral direction pass through a return-preventing apparatus 154 to be separated and fed into the pressing and moving apparatus 112 via a communication path 156 one by one.

The return-preventing apparatus 154 is disposed adjacent to the rotary disk 130 and it has a function of preventing the tokens, which have been fed out, from being returned back to the side of the feeding-out apparatus 122. Accordingly, the return-preventing apparatus 154 can be replaced with another apparatus having a similar function, and a configuration where the return-preventing apparatus 154 is not disposed unless it is required can be adopted. The return-preventing apparatus 154 is composed of a stationary roller 158 and a moving roller 160 in the embodiment. The moving roller 160 is resiliently biased to approach the stationary roller 158 by a spring (not shown).

In the case of a standby state where no token 104 passes through the return-preventing apparatus 154, a distance between the stationary roller 158 and the moving roller 160 is kept to be a gap narrower than the diameter of the token 104. In the case where the token 104 passes through the return-preventing apparatus 154, the moving roller 160 is moved by the token 104, and after the diametrical portion of the token 104 passes through the return-preventing apparatus 154, the return-preventing apparatus 154 is resiliently returned back to the standby state by the spring. Thereby, when the token 104 is returned back to the side of the feeding-out apparatus 122, the moving roller 160 must be resiliently moved against the moving roller 160, so that a returning movement is restricted.

Next, the pressing and moving apparatus 112 will be explained. The pressing and moving apparatus 112 has a function of positively pressing and moving the tokens 104 fed out of the feeding-out apparatus 122, one by one, in a predetermined direction. Accordingly, the pressing and moving apparatus 112 can be replaced with another apparatus having a similar function. The pressing and moving apparatus 112 in the embodiment includes a pressing and moving member 162 and a guiding member 164.

First, the pressing and moving member 162 will be explained. The pressing and moving member 162 has a function of forcibly pressing and moving the tokens 104 moving in the predetermined direction at a predetermined velocity and fed out of the aligning and supplying apparatus 110 one by one. The pressing and moving member 162 in the embodiment is a rotational direction front end with three propeller-shaped pressing and moving blades 168A, 166B, 168C formed on a rotary member 166. The rotary member 166 is fixed at a distal end of a rotary shaft 170. The rotary shaft 170 is rotationally driven from the reduction gears 138 of the rotary disk 130 via a transmission apparatus 172 so as to rotate in a clockwise direction in FIG. 1 in synchronization with the rotary disk 130.

These pressing and moving blades 168A, 166B, and 168C are disposed so as not to be positioned above an upper face of the token 104. In the embodiment, this condition is satisfied by making the pressing and moving blades 168A, 166B, and 168C thinner than the thickness of the token 104. The reason is because a surface of the token 104 is prevented from being shaded by blocking light from a projector 188, described later, by the pressing and moving blades 168A, 166B, and 168C.

The guiding member 164 has a function of guiding the tokens 104 pressed and moved by the pressing and moving member 162 in a predetermined direction. Accordingly the guiding member 164 can be replaced with another apparatus having a similar function. The guiding member 164 in the embodiment is a partial peripheral face 176 of a pressing and moving member circular recessed portion 174 formed in an approximately circular recessed shape.

A pressing and moving member bottom face 178 of the pressing and moving member circular recessed portion 174 is formed to be flush with the base face 146 of the first circular recessed portion 134, and it communicates with the first circular recessed portion 134 via a communication path 156. The rotary member 166 is disposed in the pressing and moving member circular recessed portion 174 concentrically, and it is rotated in a clockwise direction in FIG. 1 in synchronization with the rotary disk 130.

Thereby, the token 104 which has passed through the return-preventing apparatus 154 is immediately pressed by the pressing and moving member 162, and after it is turned by about 90 degrees while sliding on the pressing and moving member bottom face 178 and while being guided by the arc-shaped peripheral face 176 of the guiding member 164, it is fed out from an outlet 180. A path on which the token 104 is pressed and moved by the pressing and moving member 162 is an imaging path 182, and the imaging apparatus 106 is disposed to face the imaging path 182.

Next, the imaging apparatus 106 will be explained. The imaging apparatus 106 has a function of imaging a face of a token 104 moving on the imaging path 182 to acquire image information. Accordingly, the imaging apparatus 106 may be replaced with another apparatus having a similar function. The imaging apparatus 106 in the embodiment is fixed to a bracket 184 fixed to the base 132 such that its position can be adjusted, and it is disposed so as to image an upper face of a token 104 sliding on the pressing and moving member bottom face 178. However, the imaging apparatus 106 can be disposed to image a lower face of the token 104. The imaging apparatus 106 includes at least a camera 186 and a light emitting apparatus 188, see FIG. 6.

Next, the camera 186 will be explained. The camera 186 has a function of imaging a face of a token 104 facing the camera 186 to acquire image information of a pattern of the face. The camera 186 in the embodiment is, for example, a CCD camera, such as a type which uses a shutter and of a type which does not use a shutter, and any system can be adopted if a token 104 which is moving at a high velocity can be imaged.

Next, the light emitting apparatus 188 will be explained. The light emitting apparatus 188 has a function of emitting light on a token 104 intensively. The light emitting apparatus 188 is required to have high luminance and high durability in order to image many tokens 104 which are moving at a high velocity, and it is preferable that, for example, many white LEDs are disposed so as to face a token 104.

Next, the timing sensor unit 190 in the imaging apparatus 106 will be explained. The timing sensor unit 190 has a function of outputting timing signals for setting at least an imaging timing of the camera 186 and a light emitting timing of the light emitting apparatus 188 in linkage with a token 104 which is moving. Accordingly, the timing sensor unit 190 can be replaced with another apparatus having a similar function.

The timing sensor unit 190 in the embodiment outputs a timing signal by indirectly detecting a position of the pressing and moving member 162, but it can output a timing signal by directly detecting the position of the pressing and moving member 162, for example, directly detecting positions of the pressing and moving blades 168A, 168B, and 168C. The timing sensor unit 190 in the embodiment, shown in FIG. 4, includes three time acting pieces 192, 194, and 196 fixed to the rotary shaft 170 in the base 132 to correspond to the pressing and moving blades 168A, 168B, and 168C and a sensor 198 for detecting these time acting pieces 192, 194, and 196. The sensor 198 is disposed to face a rotation path of the acting pieces 192, 194, and 196 and it is fixed to the base 132. The sensor 198 is a photo-electric sensor of light transmission type composed of, for example, a light emitting device and a light receiving device, and it outputs a timing signal TS when light from the light emitting device is blocked by distal ends of the acting pieces 192, 194, and 196.

A position where the sensor 198 is disposed is a position just before a position suitable for imaging a face of a token 104 using the imaging apparatus 106. Light from the light emitting device of the sensor 198 is blocked by one of the acting pieces 192, 194, and 196 at the position, and the sensor 198 outputs the timing signal TS by the blocking. The light emitting apparatus 188 emits light after the timing signal TS is delayed by a predetermined time by adjusting means 200 described later. The light emitting timing is a timing suitable for imaging a whole face of a token 104 pressed and moved by the pressing and moving member 162. The camera 186 conducts imaging processing in synchronization with light emission from the light emitting apparatus 188.

Figure 6:
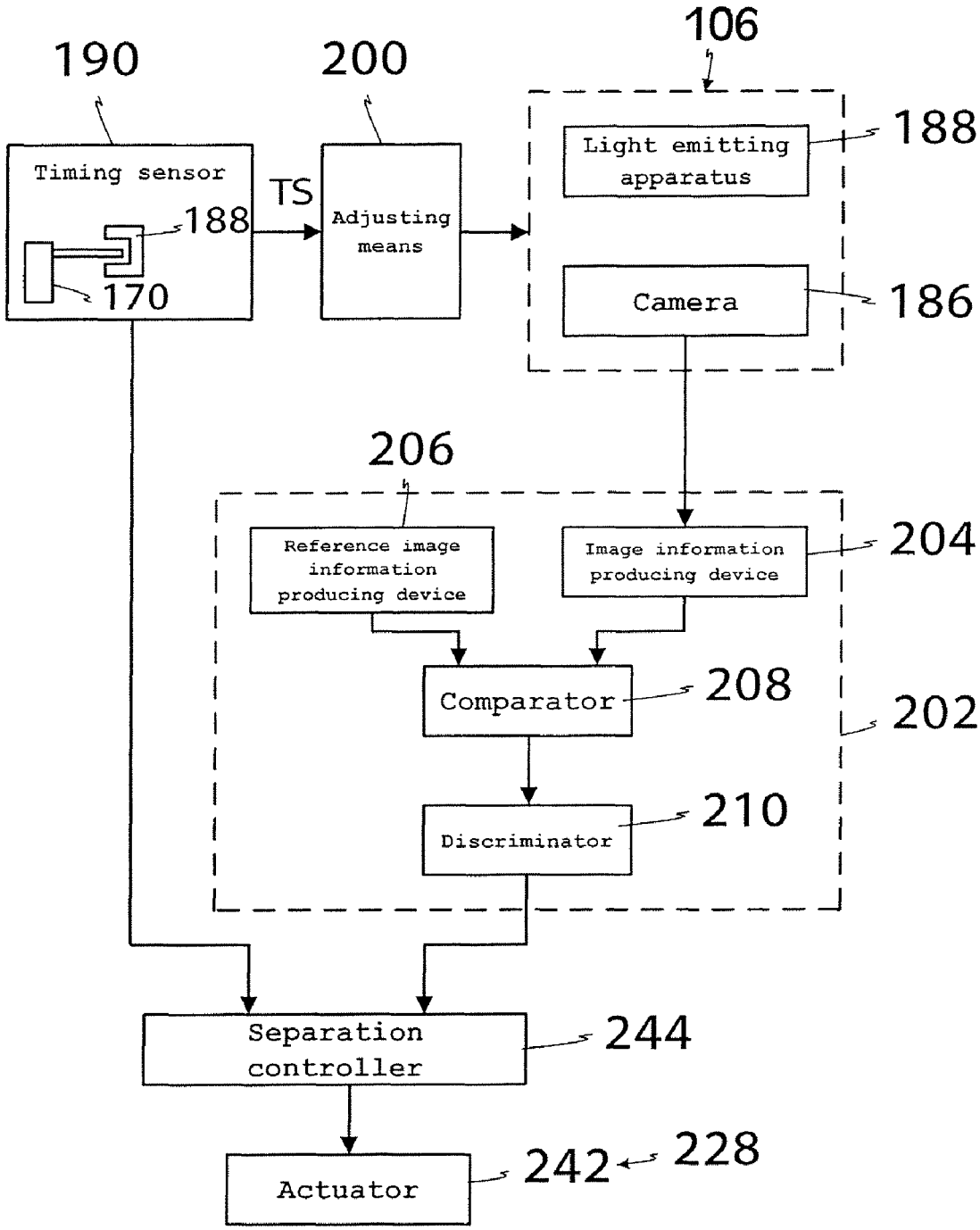
FIG. 6 is a block diagram of a control apparatus of the token selecting apparatus provided with a token image acquiring apparatus of an embodiment of the present invention.

Next, a discriminator unit 202 for the image information imaged will be explained with reference to FIG. 6. The discriminator unit 202 has a function of converting an image imaged by the imaging apparatus 106 to image information and comparing the image information with reference image information to conduct discrimination about whether or not the token imaged is a real token or a fake token. The image data can be presented in a digital format. Accordingly, the discriminator unit 202 can be replaced with another apparatus having a similar function. The discriminator unit 202 in the embodiment includes an image information producing device 204 which produces image information from the image acquired from the imaging apparatus 106, a comparator 208 which compares the image information from the image information producing device 204 with reference image information stored in a reference image information producing device 206, and a discriminator circuit 210 which discriminates real/fakeness of a token 104 based upon a signal from the comparator 208 to output a real token signal or a fake token signal.

Next, an operation of the above mentioned token image acquiring apparatus 100 will be explained.

Tokens 104 are stored in the storing bowl 120 in their bulk state, see FIG. 3. The electric motor 136 is actuated and the imaging apparatus 140 is also put in a standby state based upon an actuation signal. The first rotary shaft 140 is rotated via the reduction gears 138 according to rotation of the electric motor 136, so that the rotary disk 130 is rotated in a clockwise direction in FIG. 4.

Simultaneously, the second rotary shaft 170 and the rotary member 166 are rotated via the transmission apparatus 172 in the clockwise direction in FIG. 4 by the reduction gears 138 in synchronization with the rotary disk 130.

The tokens 104 in the storing bowl 120 are stirred by the stirrer 142 according to rotation of the rotary disk 130 and tokens 104 drop through the through-holes 128. Each of the dropped tokens 104 is pressed by the pressing protrusion 144 and rotated in a clockwise direction together with the rotary disk 130 while its lower face is guided by the base face 146 and its peripheral face is guided by an inner peripheral face of the first circular recessed portion 134.

During the rotation course, the token 104 is guided in the peripheral direction of the rotary disk 130 by the restricting pins 150, 152. The token 104, as guided in the peripheral direction, moves the moving roller 160 to pass through the return-preventing apparatus 154. The token 104 which has passed through the return-preventing apparatus 154 passes through the communication path 156 to reach the rotation path 212 of the pressing and moving blades 168A, 168B, and 168C.

The token 104 which has reached the rotation path 212 is immediately pressed by the pressing and moving member 162 which is an advancing direction front end of either of the pressing and moving blades 168A, 168B, and 168C, and it is moved on the arc-shaped imaging path 182 while being guided by the peripheral face 176 of the pressing and moving member circular recessed portion 174. In the movement course, since light of the sensor 198 is blocked by one of the acting pieces (192), (194), and (196) rotating integrally with the pressing and moving member 162 just before the token 104 reaches the imaging position of the imaging apparatus 106, the sensor 198 outputs a timing signal TS. The timing signal TS outputs a light emitting signal to the light emitting apparatus 188 of the imaging apparatus 106 and outputs an imaging signal to the camera 186 with a slight predetermined time delay as adjusted by the adjusting means 200 which can compensate for different size tokens.

Thereby, when the token 104 reaches the imaging position of the camera 186, the light emitting apparatus 188 emits light to irradiate the token 104 with intense light instantaneously and the camera 186 conducts an imaging processing to capture an image of the token. An image acquired by the camera 186 is converted to predetermined image information by the image information producing device 204 and the image information is outputted to the comparator 208. The image information is compared with reference image information representing a real token from the reference image information producing device 206 in the comparator 208. An output of the comparator 208 is discriminated by the discriminator 210 and the discriminator 210 outputs a real token signal or a fake token signal.

As described above, the position of the pressing and moving member 162 is detected by the timing sensor 190 which directly or indirectly detects the position while the token 104 is being positively pressed and moved by the pressing and moving member 162, the light emitting apparatus 188 is caused to emit light based upon the timing signal TS from the timing sensor 190, and an imaging processing is performed by the camera 186. Thereby, since any inconsistency between the position of the token 104, and the light emitting timing of the light emitting apparatus 188 and the imaging processing of the camera 186 can be prevented, imaging can be reliably performed for each token 104. After the token 104 which has passed through the imaging apparatus 106 is turned on the arc-shaped path of the imaging path 182 by about 90 degrees, it is fed out from the outlet 180.

Incidentally, the pressing and moving member 162 need not be formed on the rotary member 166 but it can be alternatively formed on a linear moving member (not shown). However, since other apparatus can be disposed around the imaging path 182 by forming the pressing and moving member 162 on the rotary member 166, there is an advantage in that the whole apparatus can be reduced in size.

Next, the token selecting apparatus 102 provided with the token image acquiring apparatus 100 of the present invention will be explained. Since the token selecting apparatus 102 has a configuration obtained by adding the separator unit 108 to the abovementioned token image acquiring apparatus 100, explanation of the token image acquiring apparatus 100 is omitted.

Figure 5:
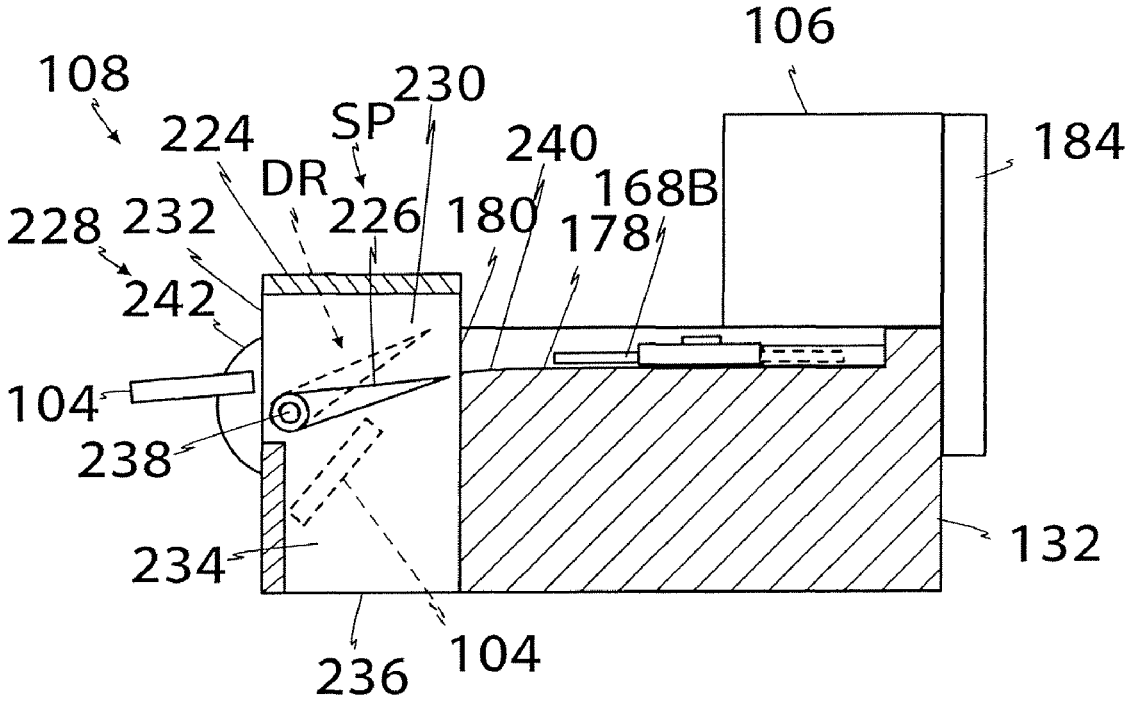
FIG. 5 is a sectional view of the token selecting apparatus, taken along line B-B in FIG. 4.

The separator unit 108 has a function of sorting tokens 104 fed out from the outlet 180 of the token image acquiring apparatus 100 to real tokens and fake tokens based upon the discrimination result in the discriminator 210 as shown in FIG. 5. The separator unit 108 is disposed adjacent to the outlet 180, and is fixed to the base 132. Separator unit 108 includes a rectangular box-shaped frame 224 a deflecting member 226, and an actuator 228.

The frame 224 defines a path for tokens 104 and it is attached to base 132. The frame 224 has a separating path 230 formed on extension of the outlet 180, a real token outlet 232 formed at an end portion of the separating path 230, a fake token path 234 which is perpendicular to the separating path 230 and extends downwardly, and a fake token outlet 236 at a lower end of the fake token path 234.

The deflecting member 226 has a function of sorting tokens 104 fed out from the outlet 180 to the real token outlet 232 or the fake token path 234. Accordingly, the deflecting member 226 can be replaced with an alternative apparatus having a similar function.

The deflecting member 226 in the shown embodiment of FIG. 5 is formed in a plate shape and it is disposed on the separating path 230, and an end portion thereof on the side of the real token outlet 232 is fixed to a swinging or pivoting shaft 238 rotatably pivoted to frame 224. An output shaft of the actuator 228 is fixed to an end portion of the swinging shaft 238 projecting beyond the frame 224.

The swinging shaft 238 is disposed below a distal end of the deflecting member 226 such that an upper face of the deflecting member 226 has almost the same inclination angle as that of an inclined face 240 contiguous to the moving member bottom face 178 just before the outlet 180. That is, the inclined face 240, just before the outlet 180 is formed in an inclination extending downward toward the outlet 180 relative to a horizontal face including the pressing and moving member bottom face 178 of the imaging path 182.

An arrangement is made so that the upper face of the deflecting member 226 can be positioned as an extension of the downward inclined face 240.

A distal end of the deflecting member 226 is ordinarily disposed at a position on an extension line of the inclination of the inclined face 240 or at a position slightly below the extension line, and the expression "flush" including both of these states is adopted in this text. The flush position is the standby position SP of the deflecting member 226.

A token 104 fed out toward the outlet 180 at a high velocity by the pressing and moving member 162 advances approximately horizontally due to an inertial force while being guided by the pressing and moving member bottom face 178. Thereby, the token 104 advances into the separating path 230 without being guided by the inclined face 240.

Since the distal end of the deflecting member 226 is disposed on the extension line of the inclined bottom face 240 or slightly below the extension line, it does not collide with the token 104 moving at a high velocity. Thereby, damage of the distal end of the deflecting member 226 due to collision of a real token 104 can be prevented.

The deflecting member 226 can be moved to a deflecting position DP shown by a broken line according to rotation of the swinging shaft 238 in a counterclockwise direction as shown in FIG. 5. When the deflecting member 226 is positioned at the deflecting position DP, it projects obliquely into the separating path 230 where the token 104 moves, and the token 104 collides against the deflecting member 226 to be turned downwardly, so that the token 104 is guided into a fake token path 234. Incidentally, the real token and the fake token can be processed in a manner reversed to the above mentioned explanation. In other words, such a configuration can be adopted that the outlet 232 is used as the fake token outlet and the outlet 236 is the real token outlet.

The actuator 228 is, for example, a rotary solenoid 242, and it is fixed to the frame 224. When the rotary solenoid 242 is not excited, the deflecting member 226 is rotated by a built-in spring and it is held at the standby position SP via the swinging shaft 238.

When the rotary solenoid 242 is excited, the deflecting member 226 is moved to the deflected position DP.

The rotary solenoid 242 is excited by a separation controller 244 based upon a fake token signal from the discriminator 210 and the timing signal TS from the timing sensor 190 to move the deflecting member 226 to the deflecting position DP, and it is demagnetized after a predetermined time period elapses to return the deflecting member 226 to the standby position SP.

It is preferable that when the fake token signal continues, the rotary solenoid 242 is not demagnetized so that the deflecting member 226 is kept at the deflecting position DP. This is because any drawback due to a movement timing inconsistency of the deflecting member 226 caused by repetition of excitation and demagnetization can be prevented.

The same operation of the token selecting apparatus 102 as that of the above mentioned image acquiring apparatus 100 is omitted and a different operation thereof, namely, an operation of the separator unit 108 will be explained. When a discrimination signal from the discriminator 210 is a real token signal, the rotary solenoid 242 is not excited and the deflecting member 226 is held at a standby position SP as shown by a solid line in FIG. 5. Since a token 104, pressed and moved by the pressing and moving member 162, moves at a high velocity, it is guided to the pressing and moving member bottom face 178 to advance from the outlet 180 to the separating path 230 in an approximately horizontal state thereof, and after the token 104 is propelled from the real token outlet 232, it is stored in a real token storing portion (not shown).

When a fake token signal is outputted from the discriminator 210, the rotary solenoid 242 is excited based upon a timing signal TS from the timing sensor 190, so that the deflecting member 226 is moved to the deflecting position DP, as shown in FIG. 5, before the fake token reaches the separating path 230. Thereby, the fake token collides against the lower face of the deflecting member 226 to be deflected downwardly and it passes through the fake token path 234 to be stored in a fake token storing portion from the fake token outlet 236. When the next token 104 is a real token, since the rotary solenoid 242 is demagnetized after a predetermined time period elapses, the deflecting member 226 is moved to return by a built-in spring to the standby position SP shown by a solid line in FIG. 5. Accordingly, after the real token jumps out from the real token outlet 232 without colliding against the deflecting member 226, it is stored in the real token storing portion.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A token image acquiring apparatus takes images of moving tokens of the same dimension comprising;

an image apparatus to acquire imaged information;

a pressing and moving member which moves tokens at a predetermined velocity across a curved transportation surface to the imaging apparatus that images the tokens pressed and moved by the pressing and moving member, the pressing and moving member includes a rotary member with a plurality of curved recessed portions, positioned between three propeller-shaped pressing and moving blades to receive respective tokens, the pressing and moving blades are disposed so as not to be positioned above an upper face of the tokens, whereby the image apparatus can take open air images of the tokens;

an aligning and supplying apparatus which supplies tokens to the pressing and moving member in a one by one mode of operation;

a timing sensor unit which detects a position of the pressing and moving member, wherein an imaging processing is performed by the imaging apparatus based upon a timing signal of the timing sensor unit, and wherein the imaging apparatus includes a light emitting apparatus and a camera, and the light emitting apparatus and the camera perform imaging processing based upon the timing signal of the timing sensor unit;

a discriminator unit which conducts a discrimination between a real and a fake token based upon information imaged by the imaging apparatus; and a separator unit includes an actuator unit, an inclined face formed to separate a token along an exit transporting path from the pressing and moving member and a pivotal plate for forming a downwardly inclined guiding face surface on an upper side of the pivotal plate relative to the exit transportation path whereby the predetermined velocity of the pressing and moving member propels the tokens from the exit transportation path across the inclined guiding face surface when positioned below a plane containing the exit transportation path, the pivotal plate has a lower deflecting surface that can be raised by the actuator unit to pivot to a token deflecting position obliquely projecting across a plane of the exit transportation path when the discriminator unit discriminates a false token to remove the false token by impacting the token downward at a substantial angle from the exit transportation path.

2. The token image acquiring apparatus according to claim 1, further comprising a guiding member which guides the tokens pressed and moved by the pressing and moving member.

3. The token image acquiring apparatus according to claim 2, wherein the pressing and moving member is a portion of a rotary member.

4. The token image acquiring apparatus according to claim 1, wherein the pressing and moving member is thinner than a thickness of the token.

5. In a compact coin dispensing apparatus for validating individual coins of the same dimension, the improvement comprising:

a rotary coin moving unit for receiving individual coins in a sequential manner and translating each coin to a predetermined station along a curved transporting path with a plurality of coin pressing members and a curved guiding path where a velocity of each coin, contacted on a peripheral side surface of the coin by rotation of one of the plurality of coin pressing members, forces the coin against the curved guiding path;

a timing sensor unit for detecting the position of the respective coins in the coin moving unit and providing a timing signal;

an image apparatus unit positioned at the predetermined station;

a light emitting apparatus positioned at the predetermined station responsive to the timing signal for a direct open illumination of a face of the coin, the image apparatus unit subsequently capturing an illuminated image of the face of the coin without any intermediate cover contacting the coin;

a storage unit for storing a reference image of an authenticated coin image;

a comparator unit for comparing the captured image of the coin with the authenticated coin image and providing an authenticated output signal when the respective images match and a fake coin signal when the responding images do not match; and a separator unit which separates a fake coin from an authentic coin in response to the comparator unit output signal wherein the separator unit includes an inclined face formed to separate a coin along an exit transporting path and a plate having an upper guiding face surface and a lower deflecting face surface which is movable between a standby position, below a plane containing the exit transporting path and flush with the inclined face and a deflected position which is separated from the inclined face to project upward into an extension of a plane of the exit transporting path to impact the fake coin downward at a substantial angle from the exit transporting path.

6. A token selecting apparatus for processing tokens of the same dimension, comprising:

a rotary disk having a plurality of through holes and having a diameter slightly larger than a diameter of the token, the rotary disk separately removes bulk tokens from a storing bowl into respective individual tokens to be fed from the storing bowl;

a rotary token moving unit for receiving individual tokens from the rotary disk in a sequential manner and translating each token to a predetermined station along a curved transporting path with a plurality of token pressing members, at a predetermined velocity for each token, the rotary coin moving unit includes a rotary member with a plurality of curved recessed portions positioned between three propeller-shaped pressing and moving blades to receive respective tokens, the pressing and moving blades are disposed so as not to be positioned above an upper face of the tokens;

an image apparatus unit positioned at the predetermined station takes open air images of the tokens;

a timing sensor unit for detecting the position of the respective tokens in the token moving unit and providing a timing signal;

a light emitting apparatus, positioned at the predetermined station responds, to the timing signal to provide a direct open illumination of a face of the token whereby the image apparatus unit subsequently captures an illuminated image of the face of the token without any intermediate cover contacting the token or interposed between the token and the image apparatus unit;

a discriminator unit includes a comparator unit which conducts a discrimination between a real and a fake token based upon information imaged by the image apparatus unit, the comparator unit compares the captured image of the token with an authenticated coin image and provides an authenticated output signal when the respective images match and a fake coin signal when the responding images do not match; and a separator unit has an inclined face formed to separate a token along an exit transporting path from the rotary token moving unit including a guiding member and a deflecting member which is movable between a standby position, below a plane containing the exit transporting path and flush with the inclined face and a deflecting position which is separated from the guiding member to project into an extension of a plane of the exit transporting path when the token is determined to be fake to impact the token downward at a substantial angle from the exit transporting path.

7. A token selecting apparatus for processing tokens of the same dimension according to claim 6, wherein an actuator unit and a pivotal plate, connected to the actuator unit, are positioned adjacent and below the exit transporting path, the pivotal plate provides the guiding member on one surface and the deflecting member on the opposite surface of the pivotal plate, the pivotal connection of the plate is below the plane of the exit transporting path.

* * * * *